US009774945B1

(12) United States Patent
Hoernschemeyer

(10) Patent No.: US 9,774,945 B1
(45) **Date of Patent: *Sep. 26, 2017**

(54) HEADSET MOUNT

(71) Applicant: Division Group, LLC, Houma, LA (US)

(72) Inventor: Zach Hoernschemeyer, Huntsville, AL (US)

(73) Assignee: Division Group, LLC, Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/602,647

(22) Filed: May 23, 2017

Related U.S. Application Data

(63) Continuation of application No. 15/093,012, filed on Apr. 7, 2016.

(60) Provisional application No. 62/281,490, filed on Jan. 21, 2016, provisional application No. 62/314,756, filed on Mar. 29, 2016.

(51) Int. Cl.
*H04R 25/00* (2006.01)
*H04R 1/10* (2006.01)
*A42B 3/30* (2006.01)

(52) U.S. Cl.
CPC ..... *H04R 1/1066* (2013.01); *A42B 3/303* (2013.01); *H04R 1/105* (2013.01); *H04R 1/1008* (2013.01)

(58) Field of Classification Search
CPC ..... A42B 3/145; A42B 3/16; A42B 3/166; A42B 3/0406; H04R 1/1066
USPC ..... 381/386, 381
See application file for complete search history.

(56) References Cited

U.S. PATENT DOCUMENTS 6,298,249 B1 * 10/2001 Locarno ..... A42B 3/14 2/417

OTHER PUBLICATIONS

Soldier Systems, Warrior West Sneak Peek—Liberator IV & V Communications Headsets from Tactical Command Industries [online], [dated Apr. 19, 2017], [retreived on May 17, 2017], Retreived from the internet <http://soldiersystems.net/2017/04/19/warrior-west-sneak-peek-liberator-iv-v-from-tactical-command-industries/.

* cited by examiner

*Primary Examiner* — Sunita Joshi
(74) *Attorney, Agent, or Firm* — Asgaard Patent Services, LLC; F. Wayne Thompson, Jr.

(57) ABSTRACT

Implementations of a headset mount are provided. In some implementations, a pair of headset mounts may be used to secure the earpieces of an electronic headset to a helmet having a suitable accessory interface (e.g., a rail system) thereon. In this way, a user wearing the helmet may adjustably position the earpieces of the electronic headset over his/her ears. In some implementations, the headset mount may comprise a housing having a body portion and a top portion, a back plate, and a wire form including a rotatable bracket that is secured thereto by a pivot. In some implementations, the bracket is configured to secure the earpiece of a headset to the wire form of the headset mount.

20 Claims, 19 Drawing Sheets

HEADSET MOUNT

CROSS REFERENCE TO RELATED APPLICATION

This is a continuation application claiming the benefit of U.S. patent application Ser. No. 15/093,012 which was filed on Apr. 7, 2016, which claims the benefit of U.S. Provisional Application Ser. No. 62/281,490, filed on Jan. 21, 2016, and U.S. Provisional Application Ser. No. 62/314,756, filed on Mar. 29, 2016, the entireties of all three applications are incorporated herein by reference in their entirety.

TECHNICAL FIELD

This disclosure relates to implementations of a headset mount for use with a helmet.

BACKGROUND

Headsets are routinely used in both military and law enforcement settings to protect a users hearing and facilitate hands-free communication. Headsets are often used in conjunction with protective headgear such as a helmet. As a result, various products have been developed to couple the earpieces of a headset of a helmet.

The 3M Peltor® ARC adaptor is configured to secure the earpiece of a headset to a helmet. Each ARC adaptor is configured to secure to a FAST helmet rail connection system and includes a wire form movable between a first position and a second position. The wire form's first position places an attached earpiece of a headset against the ear of the user and the second position moves an attached earpiece away from the ear of the user.

However, the 3M Peltor® ARC adaptor has several disadvantages. First, it cannot be secured to a helmet mounted accessory interface other than the FAST helmet rail connection system or a rail system of similar construction. Second, the earpiece secured to each wire form of an ARC adaptor may snag or drag on a foreign object or surface when the wire form is in the second position. Third, the ARC adaptor is not configured to position the earpiece of a headset secured thereto in a non-obstructive position on the helmet to which it is secured when not in use.

SUMMARY OF THE INVENTION

Implementations of a headset mount are provided. In some implementations, a pair of headset mounts may be used to secure the earpieces of an electronic headset (e.g., a Peltor® ComTac series headset) to a helmet having a suitable accessory interface (e.g., a rail system) thereon. In this way, a user wearing the helmet may adjustably position the earpieces of the electronic headset over his/her ears. In some implementations, each headset mount may be configured to rotatably position the earpiece of an electronic headset over the ear of a user and/or on top of the helmet to which the headset mount is secured. In some implementations, the headset mount may be configured to attach to an Ops-Core ARC rail, Crye Precision AirFrame rail, Team Wendy, and/or MTek rail systems, and/or rail systems of similar design and construction.

In some implementations, the headset mount may comprise a housing having a body portion and a top portion, a back plate, and a wire form. In some implementations, the top portion is configured to rotate when secured to the body portion of the housing. In this way, the top portion may be used to rotate a wire form having an earpiece of a headset attached thereto into position (e.g., over the ear of a user).

In some implementations, the body portion of the housing may have the general shape of a cylindrical segment (also referred to as a truncated cylinder). In some implementations, the top side of the body portion may have a protrusion extending therefrom. In some implementations, the protrusion may be configured to be received within a bend in the wire form and allow it to pivot thereabout.

In some implementations, the body portion of the housing may have a lip extending therefrom. In some implementations, the lip is configured to be received within a groove positioned about the interior of the top portion. In this way, the top portion rotates about the lip of the body portion.

In some implementations, the back plate of the headset mount may be configured to be received within the rail channel of a helmet rail system.

In some implementations, the wire form is configured to be rotatably secured to the housing of the headset mount. In some implementations, the bend in the wire form may be configured to fit about the protrusion extending from the body portion of the housing and rotate thereabout. In some implementations, the wire form may have a first arm and a second arm extending from the bend therein. In some implementations, the distal end of the first arm and the second arm each have an adaptor thereon configured to secure the earpiece of a headset to the wire form of the headset mount.

In another example implementation of a headset mount according to the principles of the present disclosure, the headset mount is similar to the headset mount discussed above but may include a sliding, rotatable bracket that is secured to the wire form.

In some implementations, a pivot is provided at the distal end of the wire forms arms. In some implementations, the pivot may be configured to secure the bracket to the wire form. In some implementations, the pivot is configured to be received within a slot in the bracket. In this way, the pivot may be used to slidably secure the bracket to the wire form. In some implementations, the pivot includes a rounded bearing surface about which the bracket may rotate.

In some implementations, the bracket is configured to secure the earpiece of a headset to the wire form of the headset mount. In some implementations, the body portion of the bracket may include at least one slot therein. In some implementations, the slot is configured to receive therein, slide on, and rotate about a portion of the pivot of the wire form. In some implementations, the slot is configured to allow the relative position of the opening defined by the bracket to be adjusted relative to the wire form of the headset mount. In this way, a user may adjustably position the earpiece of a headset held by the bracket over their ear.

DETAILED DESCRIPTION

FIGS. 1A-1B, 2, and 3A illustrate an example implementation of a headset mount 100 according to the principles of the present disclosure. In some implementations, a pair of headset mounts 100 may be used to secure the earpieces of an electronic headset (e.g., a Peltor® ComTac series headset) to a helmet 190 having a suitable accessory interface 192 (e.g., a rail system) thereon (see, e.g., FIG. 4). In this way, a user wearing the helmet 190 may adjustably position the earpieces of the electronic headset over his ears. In some implementations, each headset mount 100 may be configured to rotatably position the earpiece of an electronic headset over the ear of a user or on top of the helmet to which the headset mount 100 is secured. In some implementations, the headset mount 100 may be configured to attach to an Ops-Core ARC rail, Crye Precision AirFrame rail, Team Wendy, and/or MTek rail systems.

Figure 1A:
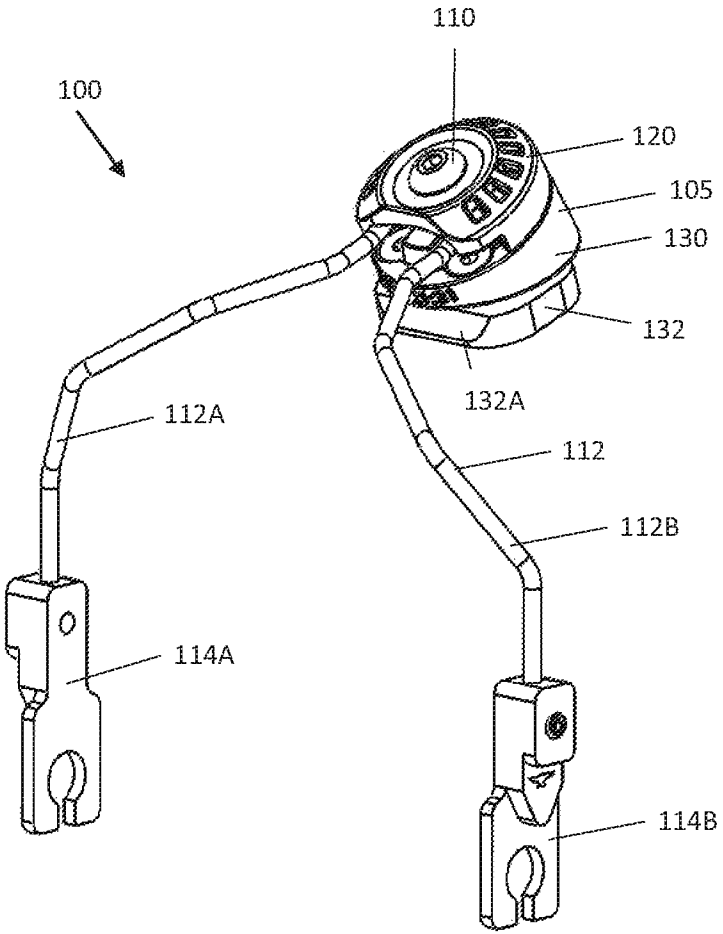
FIGS. 1A-1B, 2, and 3A-3B illustrate an example implementation of a headset mount according to the principles of the present disclosure.
Figure 1B:
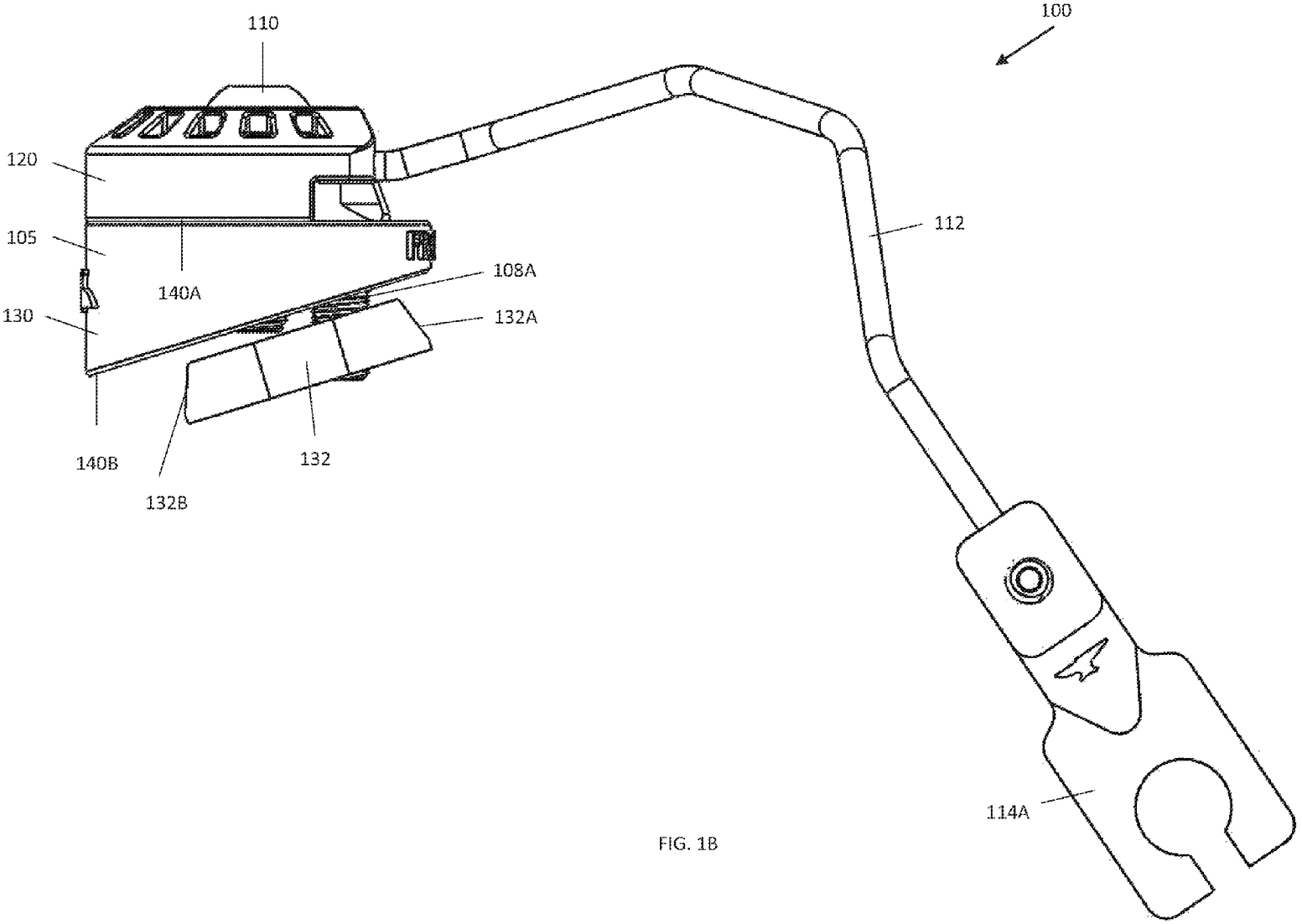
Figure 2:
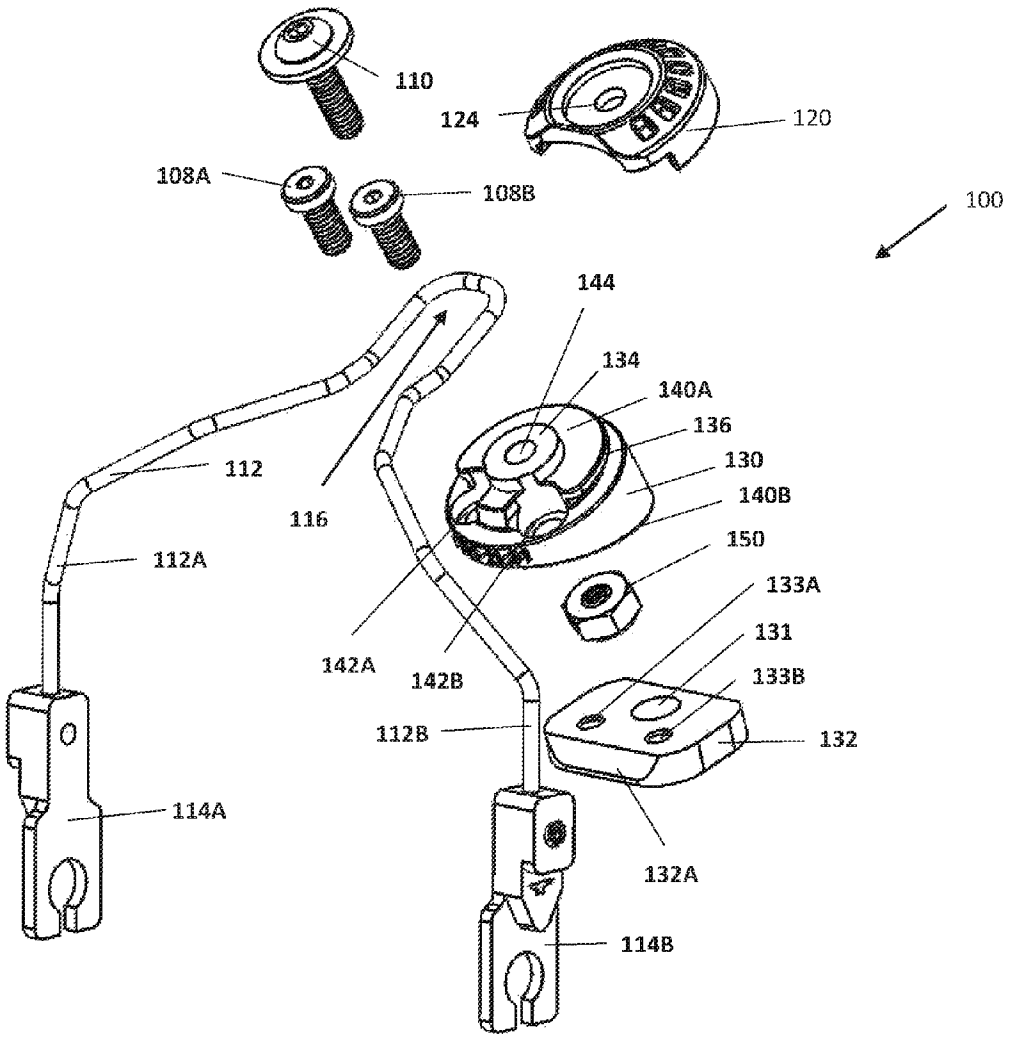

As shown in FIGS. 1A-1B, and 2, in some implementations, the headset mount 100 may comprise a housing 105 having a body portion 130 and a top portion 120, a back plate 132, and a wire form 112. In some implementations, the top portion 120 is configured to rotate when secured to the body portion 130 of the housing 105. In this way, the top portion 120 may be used to rotate a wire form 112 having an earpiece 180 of a headset attached thereto into position (e.g., over the ear of a user).

As shown in FIG. 1B, in some implementations, the body portion 130 of the housing 105 may have the general shape of a cylindrical segment (also referred to as a truncated cylinder). In some implementations, the body portion 130 of the housing 105 may be any suitable shape.

As shown in FIG. 2, in some implementations, the top side 140A of the body portion 130 may have a protrusion 134 extending therefrom. In some implementations, the protrusion may have a cylindrical, or generally cylindrical, shape (see, e.g., FIG. 3B). In some implementations, the protrusion 134 may be configured to be received within a bend 116 in the wire form 112 and allow it to pivot thereabout (see, e.g., FIG. 3A).

Figure 3A:
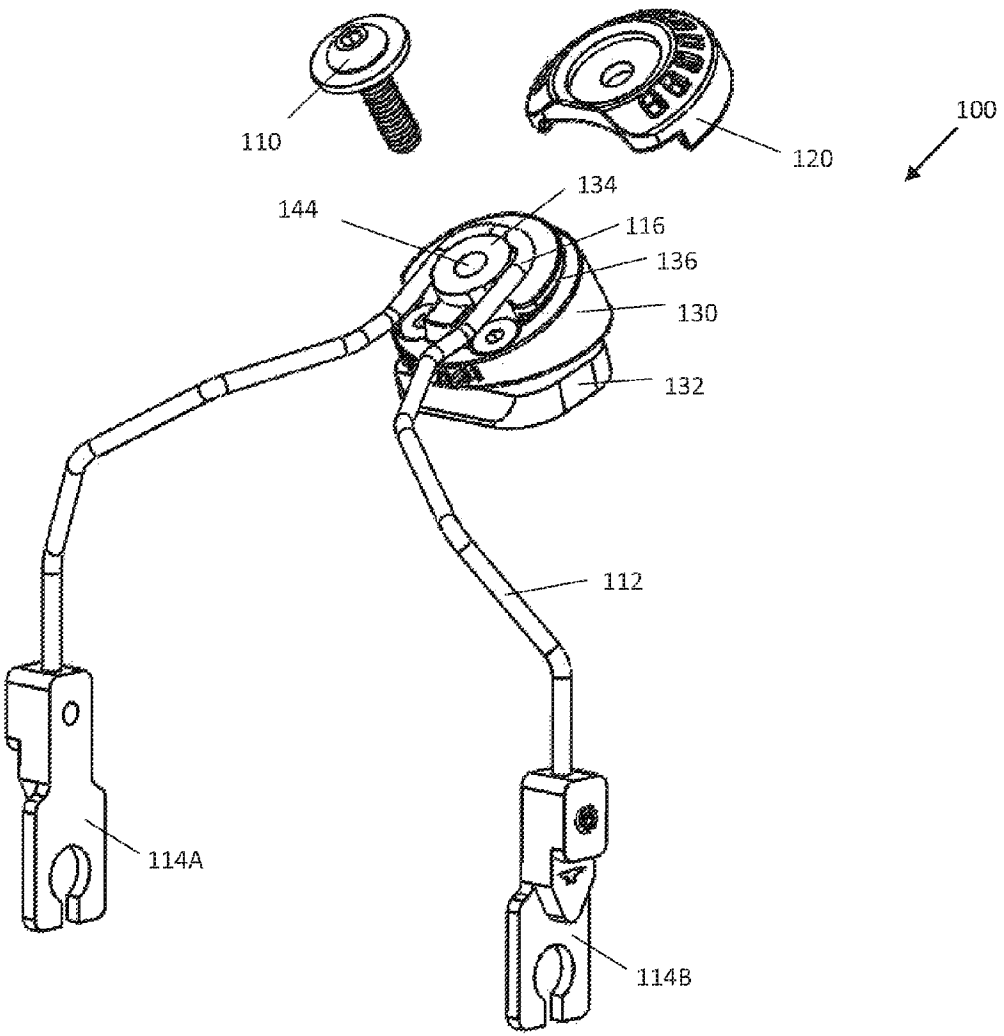
Figure 3B:
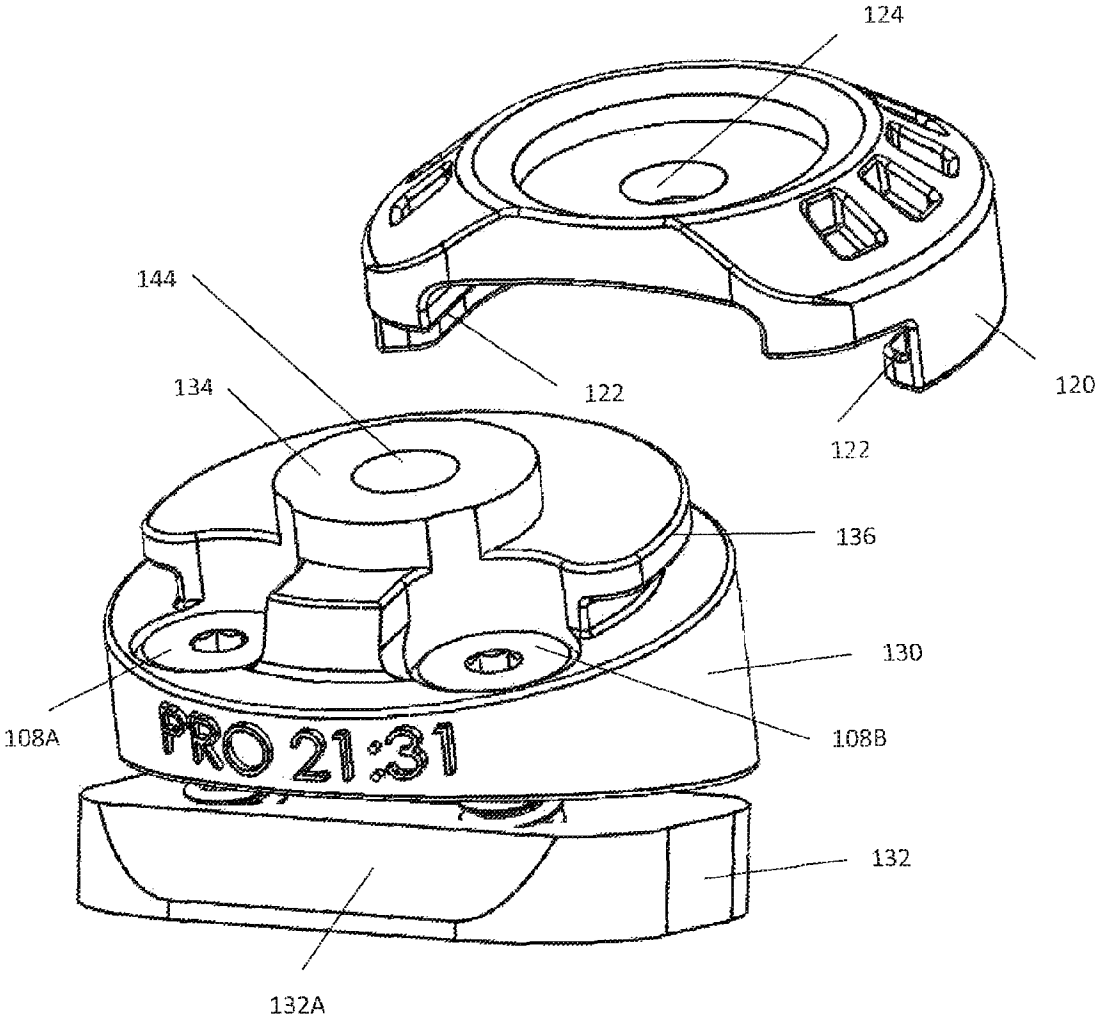

As shown in FIGS. 2 and 3B, in some implementations, the body portion 130 may have a lip 136 extending therefrom. In some implementations, the lip 136 is configured to be received within a groove 122 positioned about the interior of the top portion 120 (see, e.g., FIG. 3B). In this way, the top portion 120 may rotate about the lip 136 of the body portion 130. In some implementations, the lip 136 may extend in a semicircular arc about the protrusion 134 of the body portion 130 (see, e.g., FIG. 2).

In some implementations, a first opening 142A, a second opening 142B, and a third opening 144 may extend through the body portion 130 of the housing, between a top side 140A and a bottom side 140B thereof (see, e.g., FIGS. 1B and 2). In some implementations, the third opening 144 may extend through the protrusion 134 of the body portion 130 (see, e.g., FIG. 2).

As shown in FIG. 3B, the top portion 120 may have a generally circular shape. In some implementations, the top portion 120 may be any suitable shape. In some implementations, the groove 122 may extend about the interior of the top portion 120. In this way, the groove 122 may receive the lip 136 of the body portion 130 therein (see, e.g., FIG. 1B). In some implementations, the groove 122 may extend in a semicircular arc about the interior of the top portion 120. In some implementations, the top portion 120 may include a first opening 124 extending therethrough. In some implementations, the first opening 124 of the top portion 124 is aligned with the third opening 144 of the body portion 130 when the top portion 120 is secured to the body portion 130.

Figure 5A:
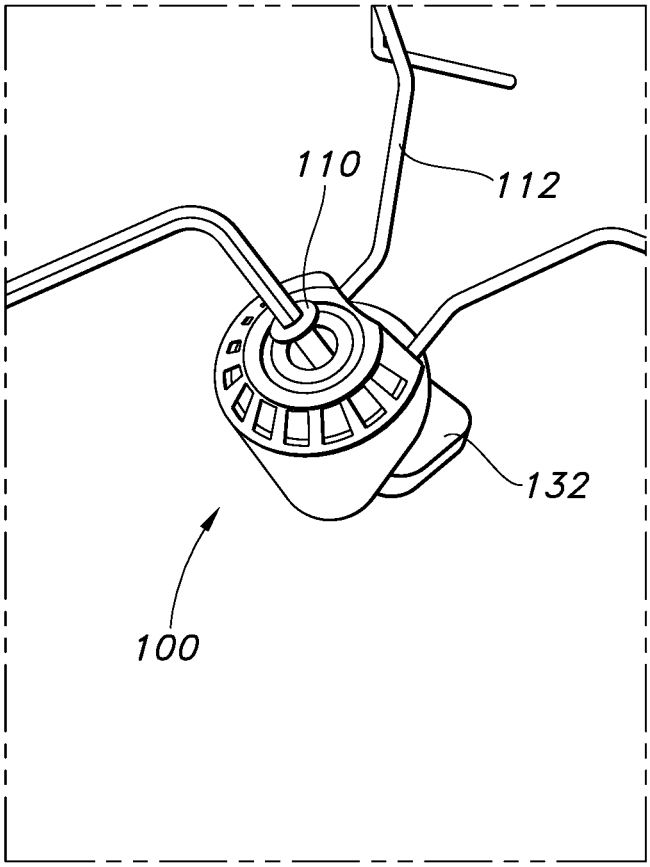
FIGS. 5A-5I illustrate an example method of installing the headset mount of FIGS. 1A-1B, 2, and 3A-3B onto a helmet having a rail system.
Figure 5B:
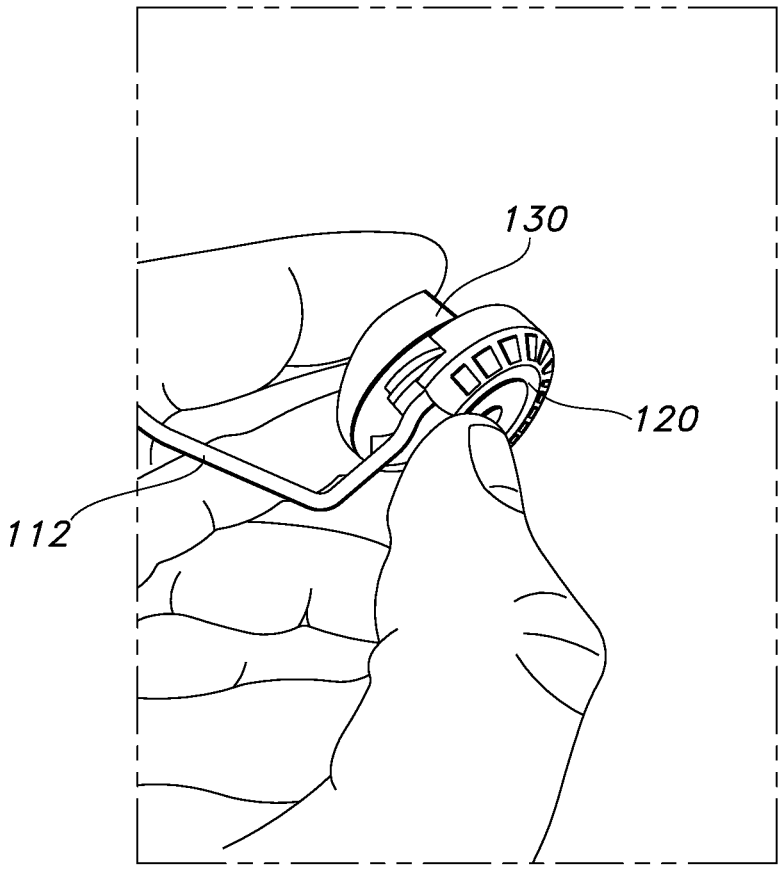
Figure 5C:
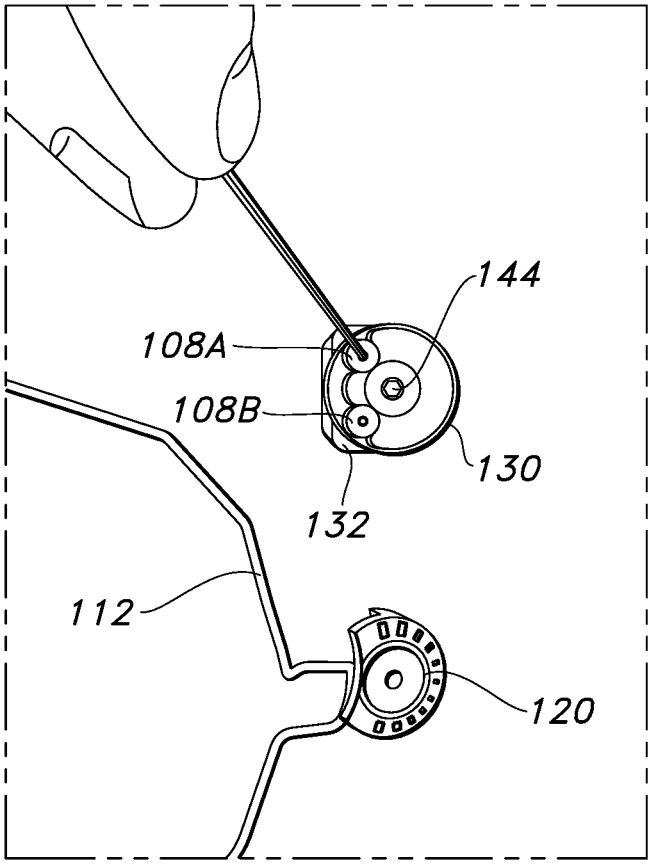
Figure 5D:
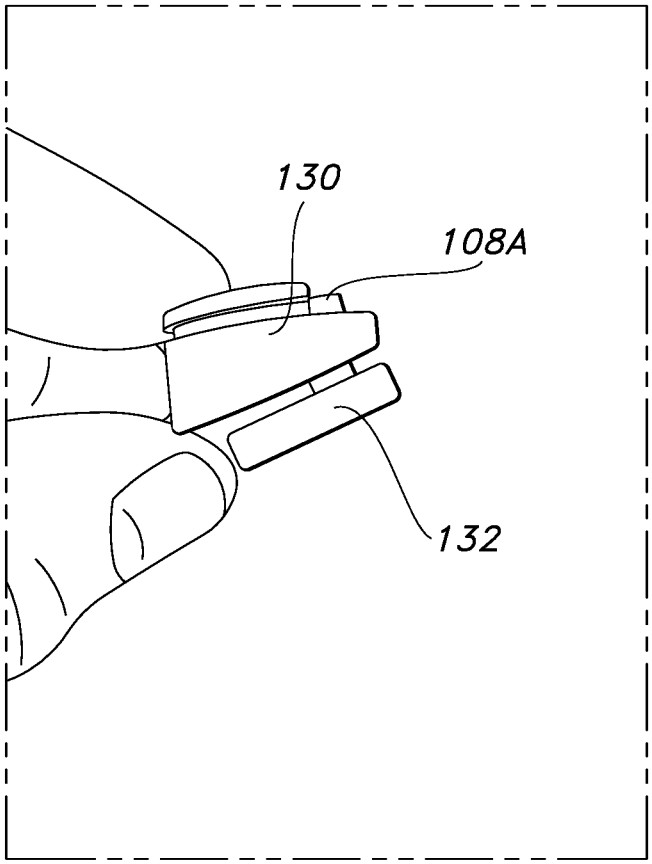
Figure 5E:
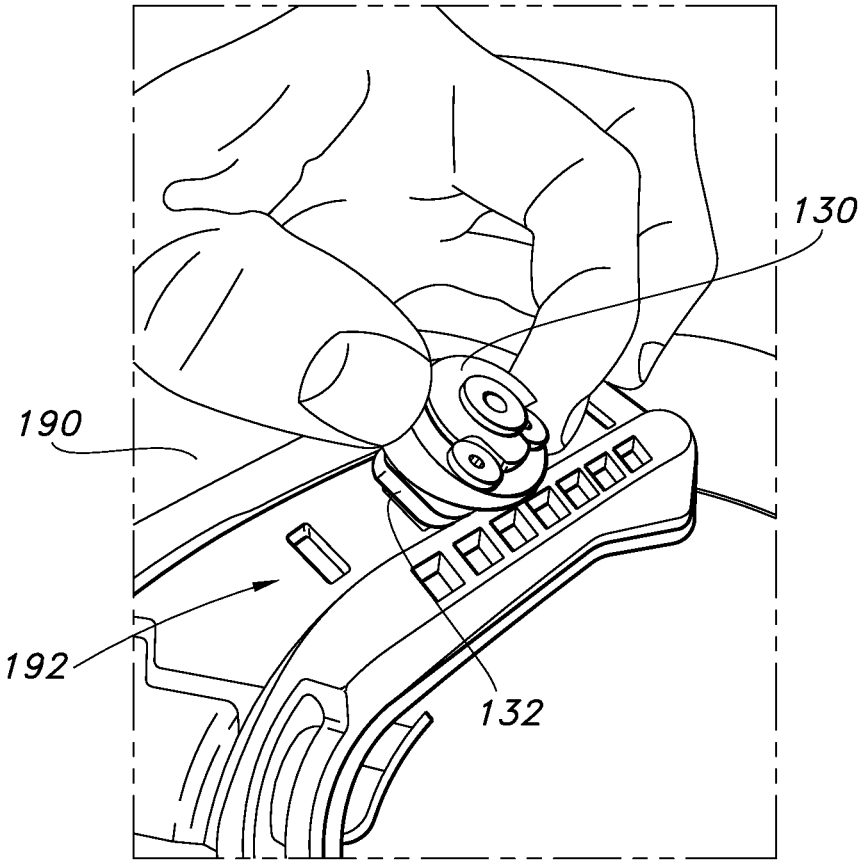
Figure 5F:
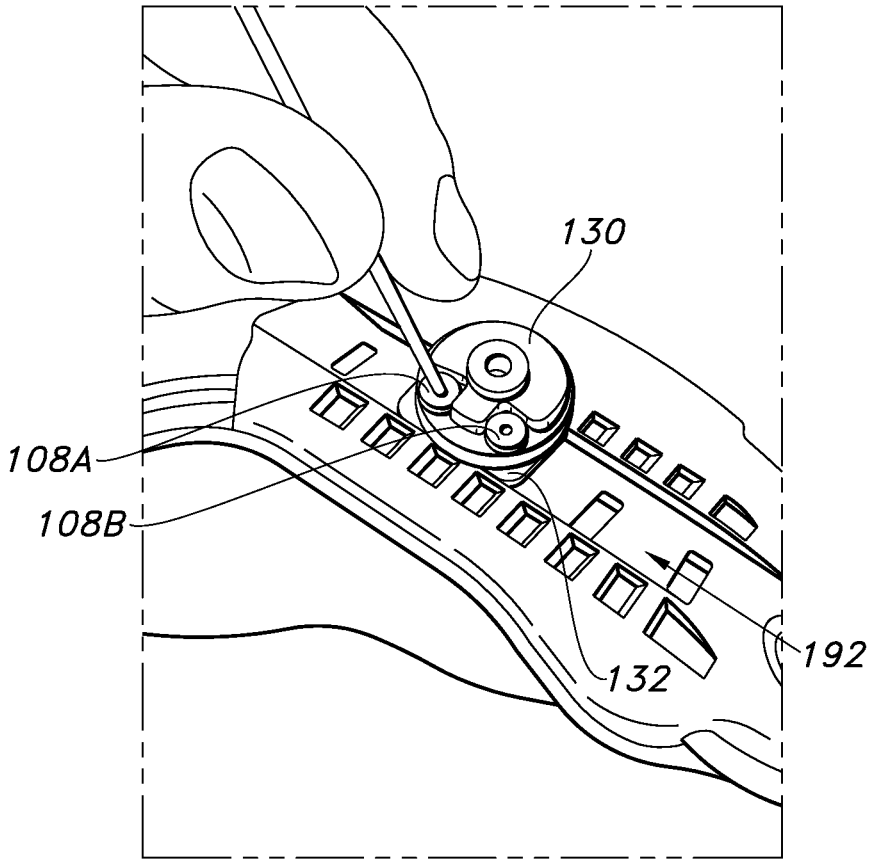
Figure 5G:
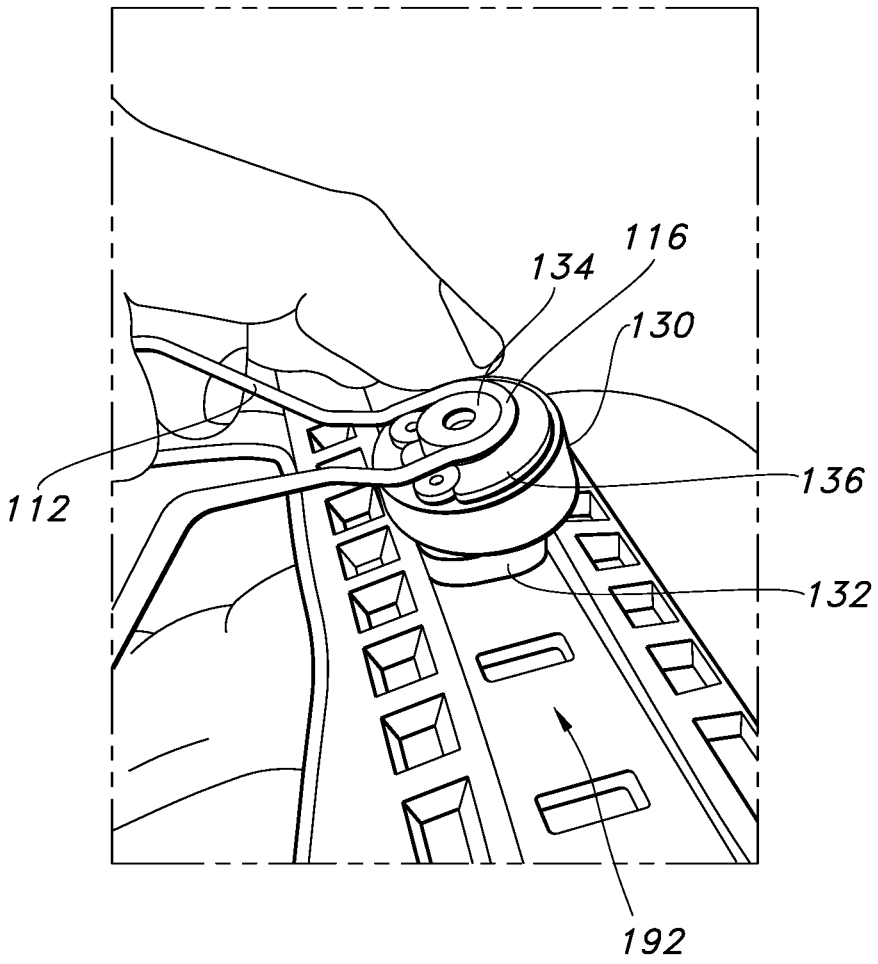
Figure 5H:
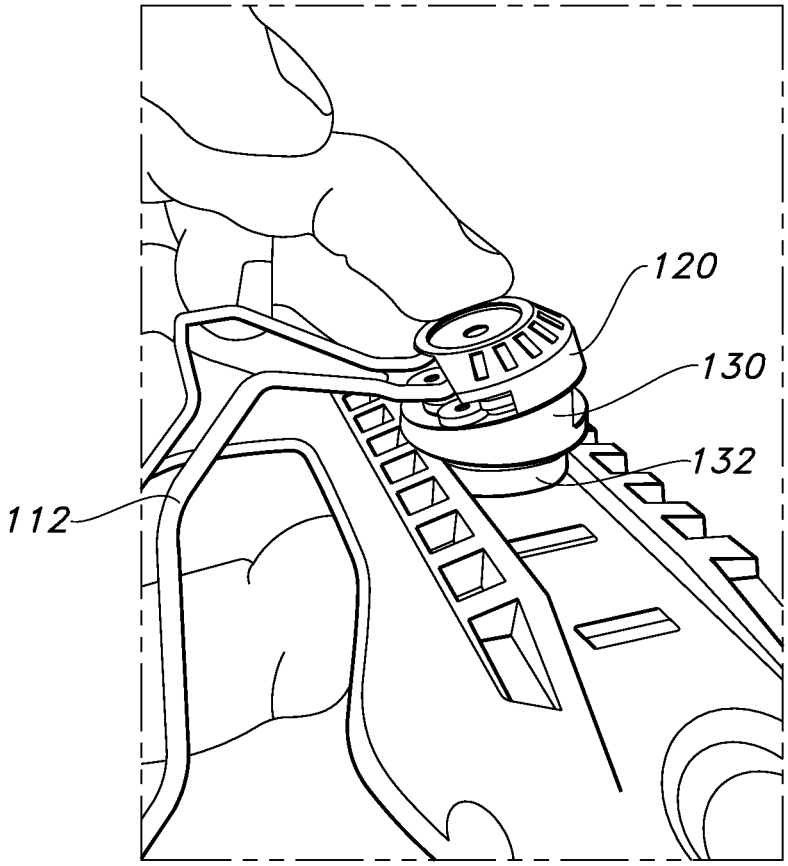
Figure 5I:
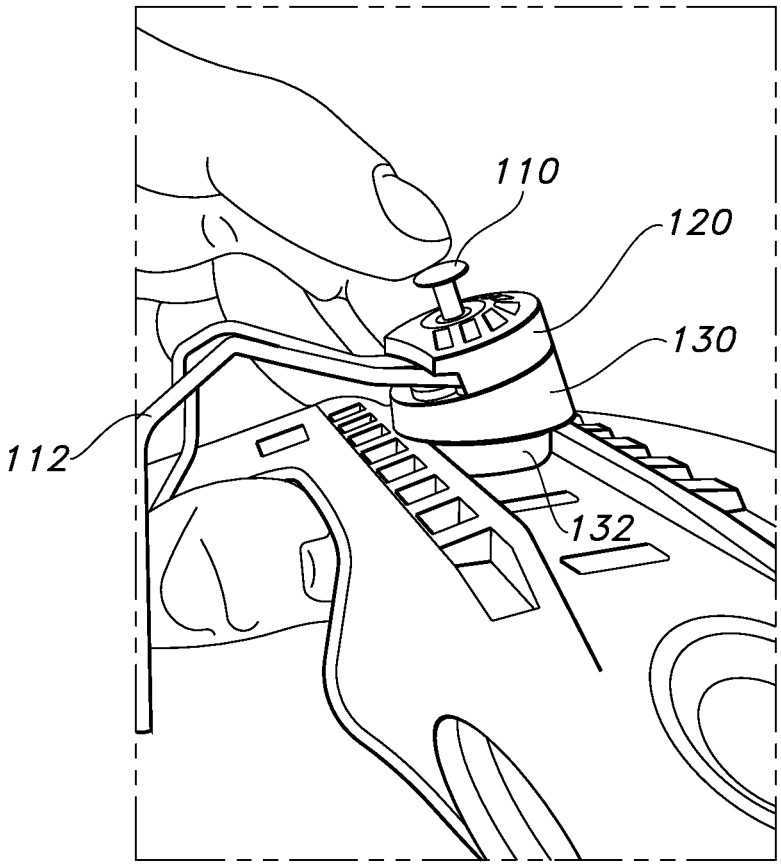

As shown in FIG. 2, in some implementations, the back plate 132 of the headset mount 100 may be configured to be received within the rail channel of a helmet mounted rail system 192 (see, e.g., FIG. 5E). In some implementations, the sides 132A, 132B of the back plate 132 may be slanted and configured to interface with the slanted walls of the rail channel (see, e.g., FIG. 5G). In some implementations, the sides 132A, 132B of the back plate 132 are constructed in the form of a male portion of a dovetail joint (see, e.g., FIG. 1B). In this way, when the back plate 132 of the headset mount 100 is inserted into the rail channel (e.g., the female portion of a dovetail joint) of a helmet mounted rail system 192 a secure connection may be achieved (see, e.g., FIG. 5I). In some implementations, the back plate 132 may have any shape suitable for being received within the rail channel of a helmet mounted rail system.

As shown in FIG. 2, in some implementations, the back plate 132 may include a first threaded opening 133A and a second threaded opening 133B, each extending between a top side and a bottom side thereof. In some implementations, the back plate 132 may have a bore 131 extending therethrough (see, e.g., FIG. 2).

As shown in FIG. 2, in some implementations, the wire form 112 is configured to be rotatably secured to the housing 105 of the headset mount 100. In some implementations, the bend 116 in the wire form 112 may be configured to fit about the protrusion 134 extending from the body portion 130 of the housing 105 and rotate thereabout (see, e.g., FIG. 3A). In some implementations, the wire form 112 may have a first arm 112A and a second arm 112*b* extending from the bend 116 therein (see, e.g., FIG. 2). In some implementations, the distal end of the first arm 112A and the second arm 112B each have an adaptor 114A and 114B, respectively, thereon. The two adaptors 114A, 114B together are configured to secure the earpiece 180 of a headset to the wire form 112 of the headset mount 100 (see, e.g., FIG. 4).

In some implementations, the housing 105 of the headset mount 100 may be manufactured from a polymer. In some implementations, the housing 105 may be manufactured from a metal (e.g., an aluminum or steel alloy). In some implementations, the housing 105 may be manufactured from any suitable material. In some implementations, the top portion 120 and the body portion 130 of the housing 105 may be manufactured from different materials.

In some implementations, the back plate 132 of the headset mount 100 may be manufactured from a metal (e.g., an aluminum or steel alloy). In some implementations, the back plate 132 may be manufactured from a polymer. In some implementations, the back plate 132 may be manufactured from any suitable material.

In some implementations, the wire form 112 of the headset mount 100 may be manufactured from a metal. In some implementations, the wire form 112 may be manufactured from any suitable material.

headset mount 100 may comprise a housing 105 having a body portion 130 and a top portion 120, a back plate 132, and a wire form 112.

To assemble a headset mount 100 constructed in accordance with the present disclosure as shown in FIG. 1A, in some implementations, place a nut 150 between the bottom side 140B of the body portion 130 and the top side of the back plate 132. The nut 150 is positioned so that the threaded opening thereof is in axial alignment with the third opening 144 of the body portion and the bore 131 in the back plate 132 (see, e.g., FIG. 2). Then, insert a first screw 108A and a second screw 108B into the first opening 142A and the second opening 142B, respectively, of the body portion 130 and threadedly secure each screw to the first threaded opening 133A and the second threaded opening 133B, respectively, of the back plate 132 (see, e.g., FIG. 3A). In this way, the back plate 132 is adjustably secured to the body portion 130 of the housing 105 (e.g., the distance between the back plate 132 and the bottom side 140B of the body portion may be varied) and the nut 150 is held in place (see, e.g., FIG. 1B). Next, position the wire form 112 so that the bend 116 thereof is resting about the protrusion 134 of the body portion 130 (see, e.g., FIG. 3A). Then, position the top portion 120 so that the groove 122 about the interior thereof will receive the lip 136 extending from the protrusion 134 of the body portion 130 when they are slid together (see, e.g., 3B). Next, slide the top portion 120 onto the body portion 130 of the housing 105. Then, insert a screw 110 through the first opening 124 in the top portion 120, into and through the third opening 144 of the body portion 130, and threadedly secure the screw 110 to the nut 150 (see, e.g., FIG. 1B). In this way, the top portion 120, and thereby the wire form 112, are rotatably secured to the body portion 130 of the headset mount 100.

To disassemble the headset mount 100, the above steps may be performed in reverse.

FIGS. 5A-5I illustrate an example method of installing a headset mount 100 constructed in accordance with the present disclosure onto a helmet 190 having a rail system 192. Initially, in some implementations, remove the screw 110 from the top portion 120 of the housing 105 (see, e.g., FIG. 5A). Then, slide the top portion 120 away from the open end of the wire form 112 and thereby remove it from the body portion 130 of the housing 105 (see, e.g., FIG. 5B). Next, remove the wire form 112 from the body portion 130 (see, e.g., FIG. 5C). Then, loosen the first screw 108A and the second screw 108B in the body portion 130 enough to create a gap between the bottom side 140B of the body portion 130 and the back plate 132 (see, e.g., FIGS. 1B and 5D). Next, slide the back plate 132 into the rail channel of the rail system 192 (see, e.g., FIG. 5E). Then, position the back plate 132 and thereby the housing 105 on the rail system 192 so that an earpiece 180 of a headset will be positioned over the ear of a user when the helmet 190 is worn. Next, tighten the first screw 108A and the second screw 108B. In this way, the housing 105 and the back plate 132 may be pulled together and thereby secured to the rail system 192 (see, e.g., FIG. 5F). Then, position the wire form 112 so that the bend 116 thereof is resting about the protrusion 134 of the body portion 130 (see, e.g., FIG. 5G). Next, position the top portion 120 so that the groove 122 about the interior thereof will receive the lip 136 extending from the protrusion 134 of the body portion 130 when they are slid together (see, e.g., 3B). Then, slide the top portion 120 onto the body portion 130 of the housing 105 (see, e.g., FIG. 5H). Next, insert a screw 110 through the first opening 124 in the top portion 120, into and through the third opening 144 of the body portion 130, and threadedly secure the screw 110 to the nut 150 (see, e.g., FIGS. 1B and 5I). In this way, the top portion 120, and thereby the wire form 112, are rotatably secured to the body portion 130 of the headset mount 100.

In use, a headset mount 100 is positioned on each side of a user's helmet 190. In this way, an earpiece 180 of a headset may be positioned over each ear of the user. In some implementations, each headset mount 100 is rotatable between at least a first position and a second position of use. In some implementations, the first position of use places an earpiece 180 of the headset over the ear of a user (see, e.g., FIG. 4). In some implementations, the second position of use places an earpiece 180 of the headset on the user's helmet (e.g., on top of the helmet).

Figure 6A:
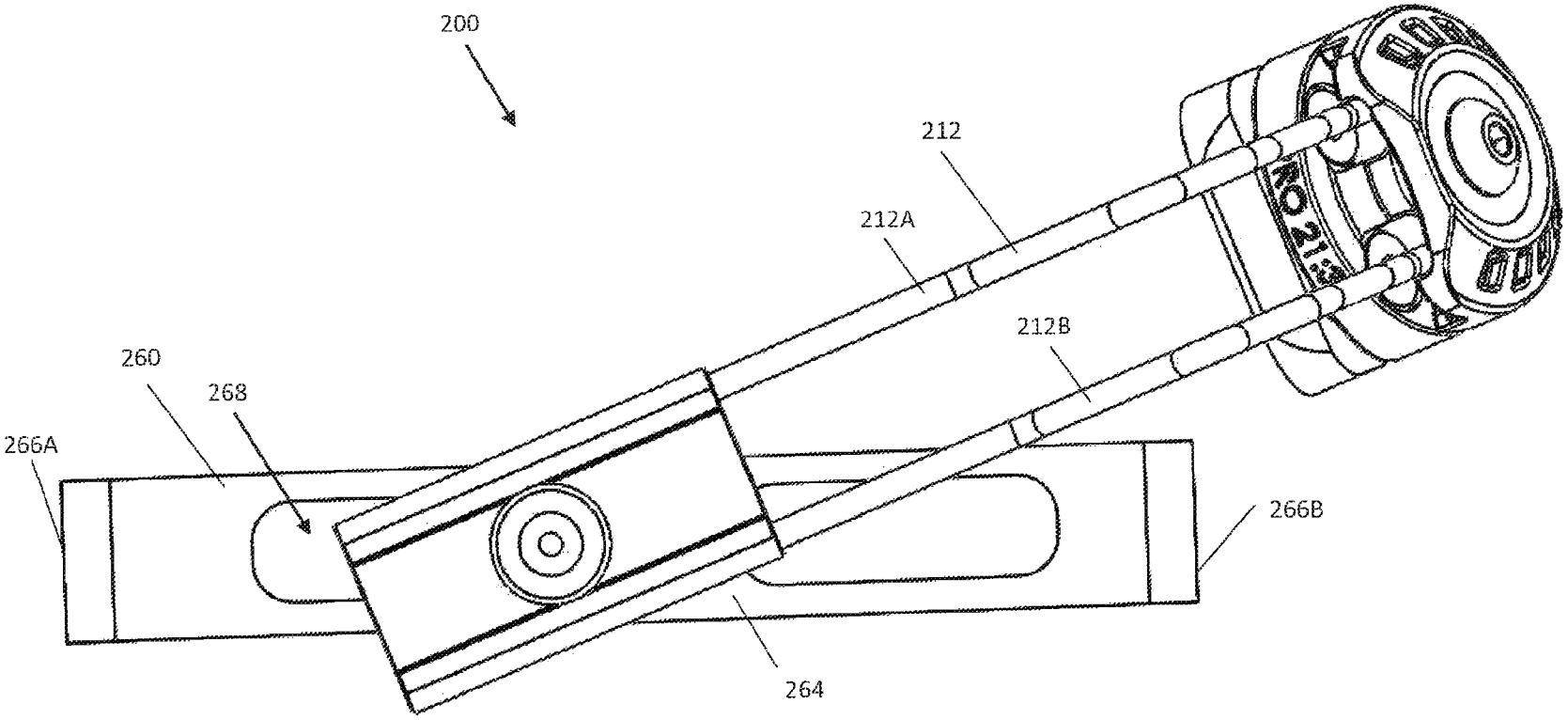
FIGS. 6A-6C illustrate another example implementation of the headset mount according to the principles of the present disclosure.
Figure 6B:
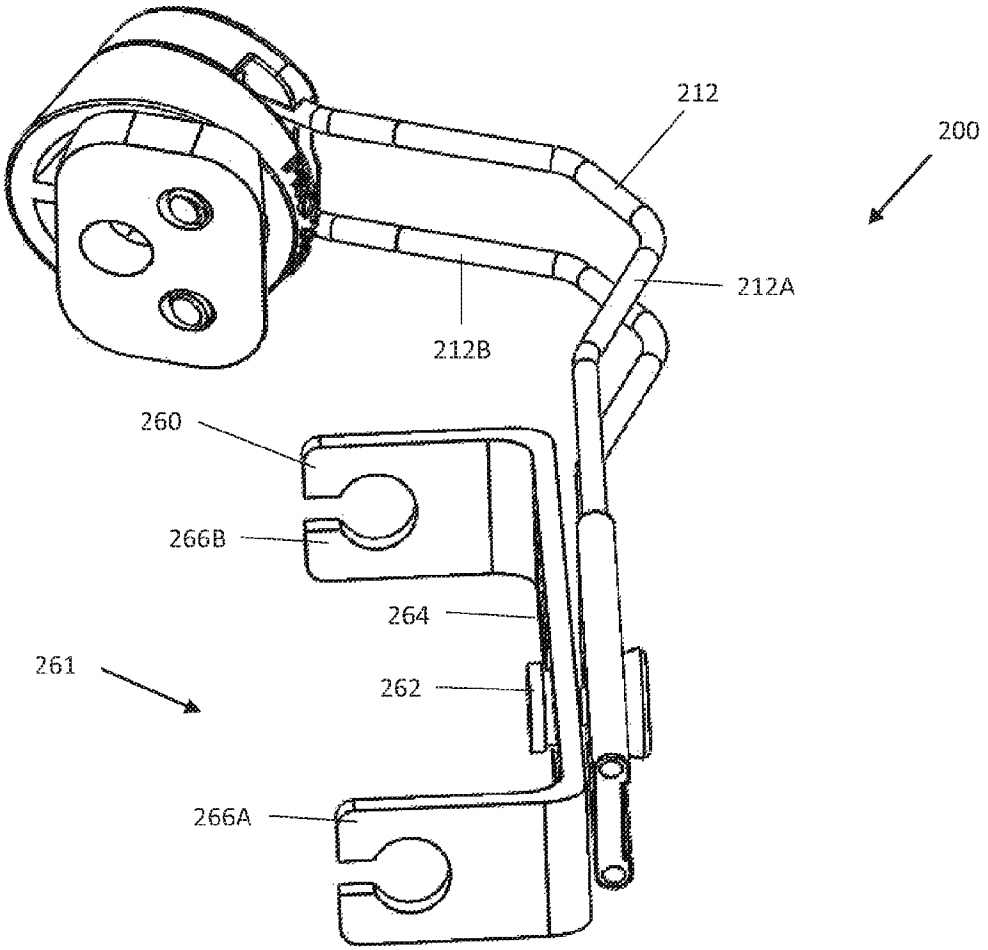
Figure 6C:
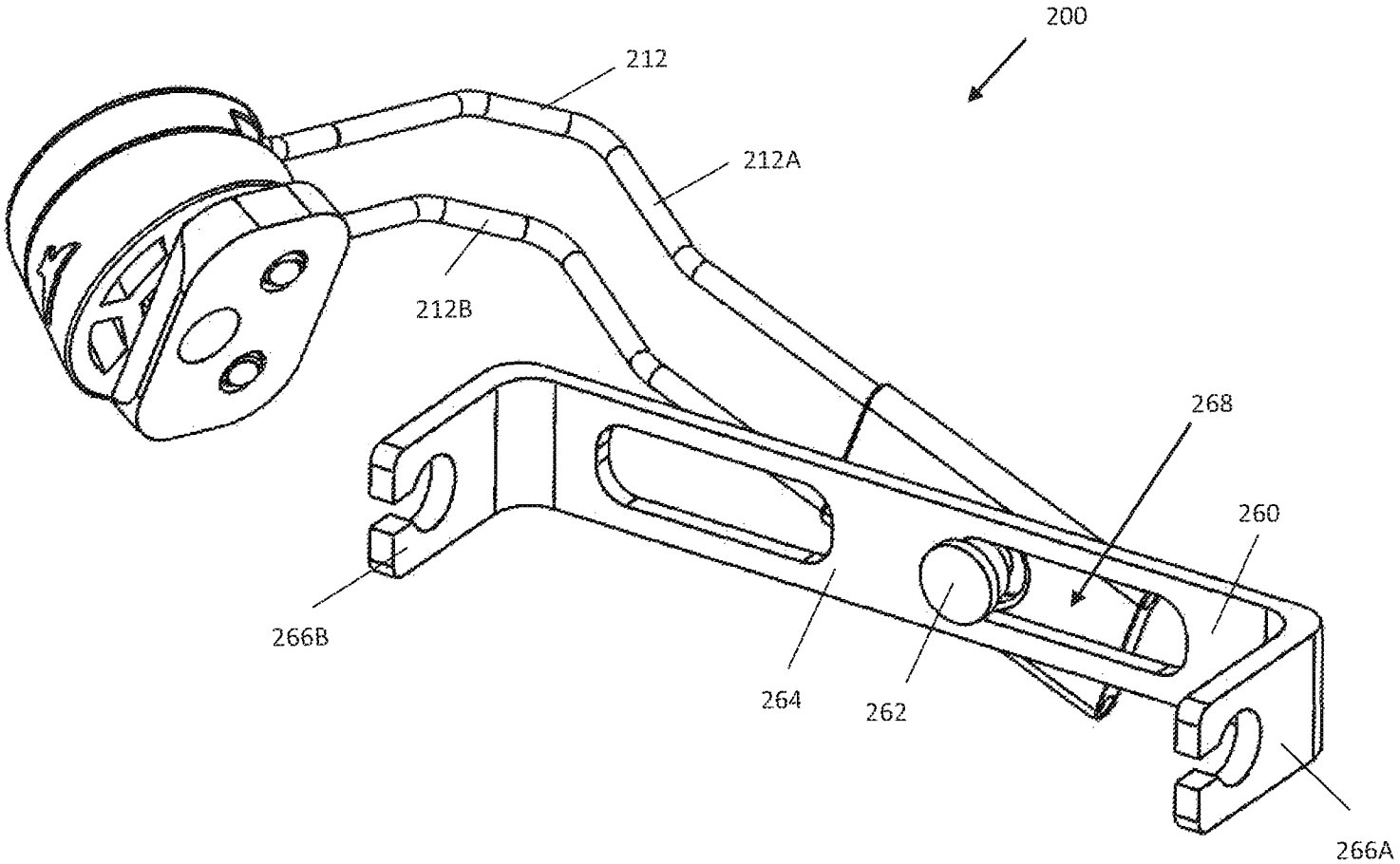

FIGS. 6A-6C illustrate another example implementation of a headset mount according to the principles of the present disclosure. In some implementations, the headset mount 200 is similar to the headset mount 100 discussed above but may include a sliding, rotatable bracket 260 that is secured to the wire form 212.

As shown in FIG. 6C, in some implementations, a pivot 262 may be secured between the distal ends of the wire forms 212 arms 212A, 212B. In some implementations, the pivot 262 may be configured to secure the bracket 260 to the wire form 212. In some implementations, the pivot 262 is configured to be received within a slot 268 in the bracket 260. In this way, the pivot 262 may be used to slidably secure the bracket 264 to the wire form 212. In some implementations, the pivot 262 includes a rounded bearing surface about which the bracket 260 may rotate.

As shown in FIG. 6B, in some implementations, the bracket 260 is configured to secure the earpiece of a headset to the wire form 212 of the headset mount 200. In some implementations, the bracket 260 may comprise an elongated body portion 264, a first arm 266A, and a second arm 266B. In some implementations, the first arm 266A and the second arm 266B may be configured to secure to a first side and a second side, respectively, of a single earpiece. In some implementations, the first arm 266A and the second arm 266B extend from the body portion 264 at a perpendicular angle relative thereto (see, e.g., FIG. 6C). In this way, an opening 261 for the earpiece of a headset is defined therebetween.

In some implementations, the body portion 264 of the bracket 260 may include at least one slot 268 therein (see, e.g., FIG. 6C). In some implementations, the slot 268 may be configured to receive therein, slide on, and rotate about a portion of the pivot 262 of the wire form 212 (see, e.g., FIG. 6C). In some implementations, the slot 268 may be configured to allow the relative position of the opening 261 defined by the bracket 260 to be adjusted relative to the wire form 112 of the headset mount 200. In this way, a user may adjustably position the earpiece of a headset held by the bracket 260 over their ear.

Figure 4:
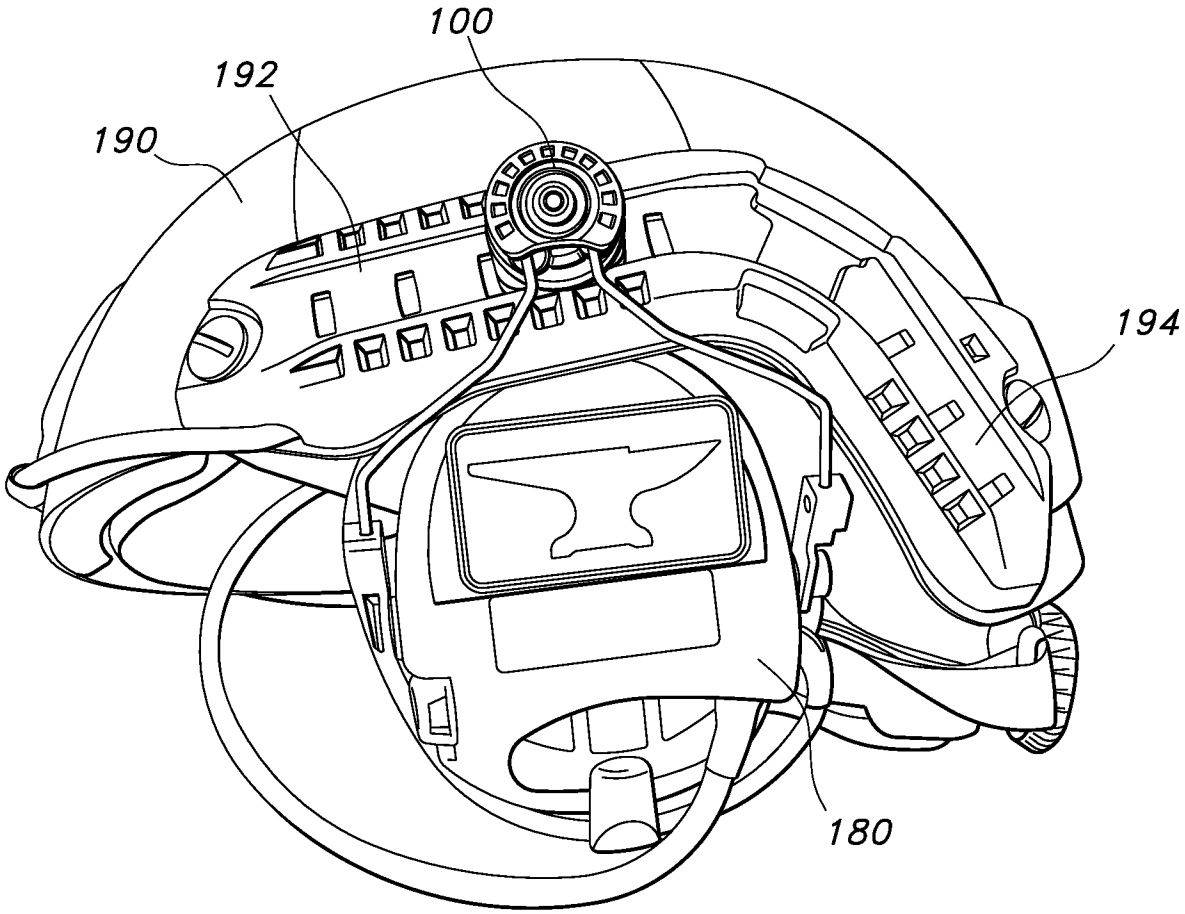
FIG. 4 illustrates a headset mount secured to a helmet having a rail system thereon.

In some implementations, the headset mount 200 may be configured to be positioned on the generally vertical portion 194 of the rail system 192 that is located behind the user's ear when the helmet 190 is worn (see, e.g., FIG. 4). Through the use of the sliding and rotating bracket 260, the headset mount 200 may be used to selectively position the earpiece of a headset over the ear of a user or the backside of the helmet 190.

Figure 7:
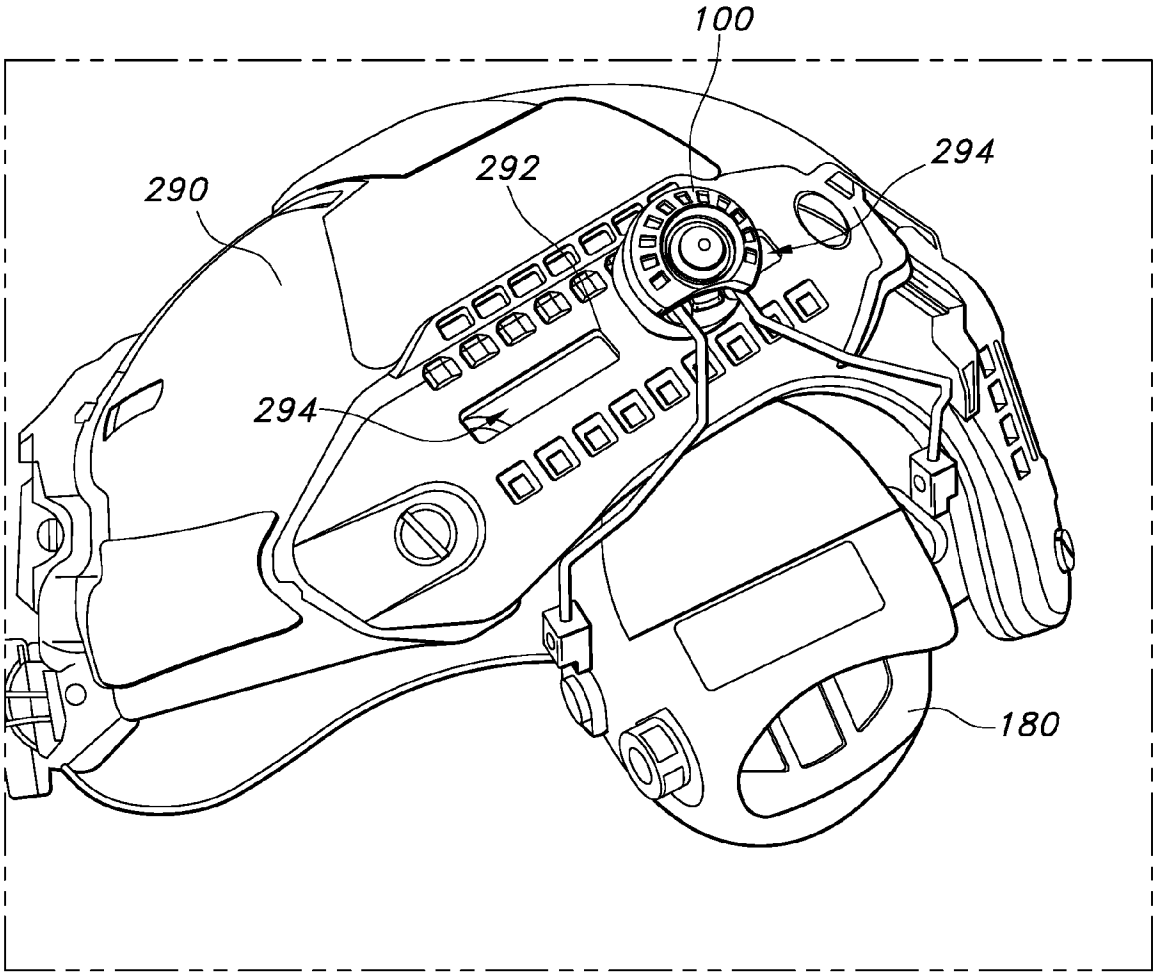
FIG. 7 illustrates a headset mount secured to a helmet having another rail system thereon.

As shown in FIG. 7, in some implementations, the back plate 132 of a headset mount 100 may be configured to fit through the opening of a rail system 292 mounting slot 294 and be secured against an interior side (i.e. the back side) thereof. In this way, the headset mount 100 may be secured to a helmet mounted rail system 292 having a mounting slot 294 therein. In some implementations, the back plate 132 may be configured so that a first side 132A thereof may be inserted through the opening of the mounting slot 294 prior to the second side 132*b* of the back plate 132 being inserted therethrough. Then, in some implementations, the back plate 132 may be oriented and positioned so that a top side thereof is perpendicular relative to the backside of the opening of the mounting slot 294. Next, in some implementations, the first screw 108A and the second screw 108B of the housing 105 are tightened causing the back plate 132 to press against the backside (interior) side of the mounting slot 294. In this way, the housing of the headset mount 100 may be secured to a rail system 292 having a mounting slot 292 therein.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A headset mount comprising:

a housing having a body portion and a top portion;

a back plate configured to secure the headset mount to an accessory interface on a helmet; and a wire form comprising a bend having a first arm and a second arm extending therefrom, a pivot is secured between a distal end of the first arm and a distal end of the second arm, a rotatable bracket is secured to the pivot, the bracket is configured to secure an earpiece of a headset to the wire form;

wherein the bend of the wire form is positioned between the top portion and the body portion of the housing, the housing is configured to allow the wire form to rotate and thereby allow a user to position the earpiece secured thereto over an ear; and wherein the bracket comprises an elongated body portion, a first arm, and a second arm, the first arm extends from a first end of the elongated body portion and the second arm extends from a second end of the elongated body portion, the first arm and the second arm of the bracket are configured to secure to a first side and a second side, respectively, of the earpiece.

2. The headset mount of claim 1, wherein the pivot includes a bearing surface about which the bracket rotates.

3. The headset mount of claim 2, wherein the elongated body portion of the bracket includes a slot therein, the slot is configured to receive therein, slide on, and rotate about the bearing surface of the pivot.

4. The headset mount of claim 1, wherein the housing is configured to allow the wire form to rotate between at least a first position of use and a second position of use, the first position of use places the earpiece secured to the bracket over an ear of a user and the second position of use places the earpiece secured to the bracket on a helmet to which the headset mount is secured.

5. The headset mount of claim 1, wherein the back plate of the headset mount is adjustably secured to the body portion of the housing.

6. The headset mount of claim 5, wherein the back plate is configured to be received within a rail channel of a helmet mounted rail system.

7. The headset mount of claim 5, wherein the back plate is configured to fit through an opening of a mounting slot of a helmet mounted rail system and be secured against a back side thereof.

8. A method of securing the headset mount of claim 1 to an accessory interface on a helmet, the method comprising:

loosening at least a first screw and a second screw that secure the back plate to the body portion of the housing to create a gap therebetween;

sliding the back plate into a rail channel of the accessory interface; and tightening the first screw and the second screw thereby securing the body portion of the headset mount to the accessory interface.

9. The method of claim 8, further comprising positioning the body portion of the housing on the accessory interface so that the earpiece secured to the bracket of the headset mount can be positioned over an ear of a user when the helmet is worn.

10. A headset mount comprising:

a housing having a body portion and a top portion;

a back plate configured to secure the headset mount to an accessory interface on a helmet; and a wire form comprising a bend having a first arm and a second arm extending therefrom, a pivot is secured between a distal end of the first arm and a distal end of the second arm, a rotatable bracket is secured to the pivot, the bracket is configured to secure an earpiece of a headset to the wire form;

wherein the bend of the wire form is positioned between the top portion and the body portion of the housing, the housing is configured to allow the wire form to rotate between at least a first position of use and a second position of use, the first position of use places the earpiece secured to the bracket over an ear of a user and the second position of use places the earpiece secured to the bracket on a helmet to which the headset mount is secured.

11. The headset mount of claim 10, wherein the pivot includes a bearing surface about which the bracket rotates.

12. The headset mount of claim 10, wherein an elongated body portion of the bracket includes a slot therein, the slot is configured to receive therein, slide on, and rotate about a portion of the pivot.

13. The headset mount of claim 10, wherein the bracket comprises an elongated body portion, a first arm, and a second arm, the first arm extends from a first end of the elongated body portion and the second arm extends from a second end of the elongated body portion, wherein the first arm and the second arm of the bracket are configured to secure to a first side and a second side, respectively, of the earpiece.

14. The headset mount of claim 13, wherein the pivot includes a bearing surface about which the bracket rotates.

15. The headset mount of claim 14, wherein the elongated body portion of the bracket includes a slot therein, the slot is configured to receive therein, slide on, and rotate about the bearing surface of the pivot.

16. The headset mount of claim 10, wherein the back plate of the headset mount is adjustably secured to the body portion of the housing.

17. The headset mount of claim 16, wherein the back plate is configured to be received within a rail channel of a helmet mounted rail system.

18. The headset mount of claim 16, wherein the back plate is configured to fit through an opening of a mounting slot of a helmet mounted rail system and be secured against a back side thereof.

19. A method of securing the headset mount of claim 10 to an accessory interface on a helmet, the method comprising:

loosening at least a first screw and a second screw that secure the back plate to the body portion of the housing to create a gap therebetween;

sliding the back plate into a rail channel of the accessory interface; and tightening the first screw and the second screw thereby securing the body portion of the headset mount to the accessory interface.

20. The method of claim 19, further comprising positioning the body portion of the housing on the accessory interface so that the earpiece secured to the bracket of the headset mount can be positioned over an ear of a user when the helmet is worn.

* * * * *